US007383924B2

(12) United States Patent
Izumi et al.

(10) Patent No.: US 7,383,924 B2
(45) Date of Patent: Jun. 10, 2008

(54) MACHINE ROOM-LESS ELEVATOR

(75) Inventors: Kazuhiro Izumi, Fuchu (JP); Kan Kawasaki, Fuchu (JP); Ikuo Asami, Fuchu (JP); Takashi Ishii, Fuchu (JP); Takanori Urata, Fuchu (JP); Shun Fujimura, Fuchu (JP); Masayuki Higashi, Fuchu (JP); Masahiro Kuramitsu, Fuchu (JP)

(73) Assignee: Toshiba Elevator Kabushiki Kaisha, Tokyo-To (JP)

( * ) Notice: Subject to any disclaimer, the term of this patent is extended or adjusted under 35 U.S.C. 154(b) by 0 days.

(21) Appl. No.: 10/549,917

(22) PCT Filed: Jul. 7, 2004

(86) PCT No.: PCT/JP2004/009658

§ 371 (c)(1),
(2), (4) Date: Nov. 15, 2006

(87) PCT Pub. No.: WO2005/005303

PCT Pub. Date: Jan. 20, 2005

(65) Prior Publication Data

US 2007/0170003 A1 Jul. 26, 2007

(30) Foreign Application Priority Data

Jul. 14, 2003 (JP) ..... 2003-196637

(51) Int. Cl.
*B66B 7/02* (2006.01)

(52) U.S. Cl. ..... 187/406; 187/250; 187/251; 187/264; 248/638

(58) Field of Classification Search ..... 187/259, 187/264, 292, 345, 406, 254, 250–251; 254/277, 254/392; *B66B 11/08, 7/06, 11/00*
See application file for complete search history.

(56) References Cited

U.S. PATENT DOCUMENTS 6,488,124 B1 * 12/2002 Yasuda et al. ..... 187/254

FOREIGN PATENT DOCUMENTS

| | | |
|---|---|---|
| GB | 2 352 221 A | 1/2001 |
| JP | 2000-44146 | 2/2000 |
| JP | 2000-153973 | 6/2000 |
| JP | 2001-253668 | 9/2001 |

(Continued)

OTHER PUBLICATIONS

U.S. Appl. No. 10/549,917, filed Sep. 20, 2005, Izumi, et al.

(Continued)

*Primary Examiner*—Peter M. Cuomo
*Assistant Examiner*—Stefan Kruer
(74) *Attorney, Agent, or Firm*—Oblon, Spivak, McClelland, Maier & Neustadt, P.C.

(57) ABSTRACT

Rubber vibration isolators are held between a base frame supporting a driving device and an upper deflecting sheave, and a support connected to car guide rails and a counterweight guide rail. The rubber vibration isolators are held between a horizontal member and vertical members of a support frame supporting lower deflecting sheaves. Transmission of vibrations generated by the driving device, the upper deflecting sheave, and the lower deflecting sheaves to the side walls of an elevator shaft can be intercepted.

14 Claims, 6 Drawing Sheets

FOREIGN PATENT DOCUMENTS

| | | | |
|---|---|---|---|
| JP | 2002-145555 | | 5/2002 |
| JP | 2003-20176 | | 1/2003 |
| JP | 2003/104657 | | 4/2003 |
| JP | 2004-189346 | | 7/2004 |
| KR | 2001-0010321 | | 2/2001 |
| WO | WO 9933742 | A1 * | 7/1999 |
| WO | WO 200127015 | A1 * | 4/2001 |
| WO | 01/42121 | | 6/2001 |
| WO | 02-18256 | | 3/2002 |
| WO | WO 200259028 | A2 * | 8/2002 |

OTHER PUBLICATIONS

U.S. Appl. No. 11/597,906, filed Nov. 29, 2006, Kawasaki, et al.

* cited by examiner

MACHINE ROOM-LESS ELEVATOR

FIELD OF THE INVENTION

The present invention relates to a machine room-less elevator system not having any machine room above an elevator shaft. More specifically, the present invention relates to techniques for intercepting the propagation of vibrations generated by a driving device and deflecting sheaves as a car and a counterweight move vertically to side walls defining an elevator shaft.

BACKGROUND ART

Various machine room-less elevator systems not having any machine room above an elevator shaft have been proposed to use space in buildings efficiently and to avoid problems relating with right to sunshine and such. The applicant of the present invention patent application proposed previously a machine room-less elevator system shown in FIG. 6. In this machine room-less elevator system shown in FIG. 6, a counterweight 2 is supported behind a car 1 that is guided by right and left car guide rails, not shown, for vertical movement in an elevator shaft. The counterweight 2 is guided by right and left counterweight guide rails, not shown. A base frame 3 is supported in a horizontal position on top of the right car guide rail and the right counterweight guide rail or on to of the left car guide rail and the left counterweight guide rail. A driving device 4 installed on the base frame 3 drives a traction sheave 5 for rotation. A lower deflecting sheave 6 is disposed near the right side wall, as viewed in FIG. 6, of the elevator shaft, and an upper deflecting sheave 7 is disposed near the rear wall of the elevator shaft.

Parts 8*a* to 8*c*, extending between the traction sheave 5 and a front hitch 9*f*, of a hoisting element 8 are wound round right and left top sheaves 1*a* and 1*b* to suspend the car 1 in 2-to-1 roping. Parts 8*d* to 8*i*, extending between the traction sheave 5 and a hitch 9*r*, of the hoisting element 8 are wound round the lower deflecting sheave 6, the upper deflecting sheave 7, and counterweight sheaves 2*a* and 2*b* to suspend the counterweight 2 in 2-to-1 roping.

This known machine room-less elevator system has many advantages; that is, the counterweight 2 is able to move for a sufficient vertical stroke, the hoisting element 8 is extended smoothly to extend their useful life, and concentrative maintenance work can be performed on the car 1.

In the machine room-less elevator system shown in FIG. 6, the base frame 3 is supported on the car guide rail and the counterweight guide rail. Therefore, it is necessary to prevent the propagation of vibrations generated by the driving device 4, the lower deflecting sheave 6 and the upper deflecting sheave 7 through the guide rails to the building. The useful life of the hoisting element 8 can be further extended by changing the position of the upper deflecting sheave 7 so that the hoisting element 8 may be further smoothly extended. There is still room for improving the space efficiency of the machine room-less elevator system by changing the position of a control panel CP for controlling the operation of the driving device 4.

DISCLOSURE OF THE INVENTION

Accordingly, it is a first object of the present invention to propose a vibration-isolating structure for supporting the driving device and the upper and the lower deflecting sheaves included in a machineroomless elevator system such as mentioned above.

A second object of the present invention is to incorporate improvements into a machine room-less elevator system to further extend the useful life of the hoisting element of the machine room-less elevator system and to further improve the space efficiency of the car of the same.

A machine room-less elevator system in a first aspect of the present invention having an elevator shaft and not having any machine room in an upper part of the elevator shaft includes: a car guided by car guide rails for vertical movement in the elevator shaft; a counterweight guided by counterweight guide rails for vertical movement in a space extending along the rear wall of the elevator shaft behind the car; a traction sheave disposed in a space above the car at the top of the elevator shaft on either the right or the left side of the car; a driving device for driving the traction sheave for rotation; a base frame fixedly supporting the driving device; a base frame support means fixed to the car guide rails and the counterweight guide rail; and vibration-isolating means interposed between the base frame and the base frame support means.

In the machine room-less elevator according to the present invention, the driving device generates vibrations when the same operates to move the car and the counterweight vertically. Since the vibration-isolating means are interposed between the base frame fixedly supporting the driving device, and the base frame support means, the vibrations generated by the driving device are not transmitted through the car guide rails and the counterweight guide rails to the side walls and the rear wall of the elevator shaft. Since the vibration-isolating means are not subject to space restrictions imposed on the conventional vibration-isolating means including rubber vibration isolators held between the driving device and the base frame, the capacity of the vibration-isolating means can be sufficiently large. Since the vibration-isolating means can be spaced sufficiently apart from each other, the spring constant with respect to vertical directions of the vibration-isolating means may be small. Thus, the propagation of vibrations generated by the driving device to the side walls and the rear wall of the elevator shaft can be surely intercepted.

The machine room-less elevator system according to the present invention may further include an upper deflecting sheave for guiding a part, extending toward the counterweight, of a hoisting element suspending the car and the counterweight, and the upper deflecting sheave may be supported on the base frame.

In the machine room-less elevator system, the upper deflecting sheave generates vibrations as the car and the counterweight are moved vertically. Since the vibration-isolating means, such as rubber vibration isolators, are held between the base frame supporting the upper deflecting sheave, and the support means, the vibrations generated by the upper deflecting sheave are not transmitted through the car guide rails and the counterweight guide rails to the side walls and the rear wall of the elevator shaft. Since the upper deflecting sheave is disposed above the base frame, a long part of the hoisting element can be extended downward from the upper deflecting sheave. Thus, the hoisting element is extended smoothly around the upper deflecting sheave to extend the useful life of the hoisting element.

The machine room-less elevator system according to the present invention may further include lower deflecting sheaves supported on a support frame connected to and extending down from the base frame to guide a part, extending downward from the traction sheave, of the hoisting element suspending the car and the counterweight.

In the machine room-less elevator system, the lower deflecting sheaves generate vibrations as the car and the counterweight move vertically. Since the support frame supporting the lower deflecting sheaves is connected to the base frame and the vibration-isolating means, such as rubber vibration isolators, are held between the base frame and the support means, the vibrations generated by the lower deflecting sheaves are not transmitted through the base frame, the car guide rails and the counterweight guide rails to the side walls and the rear wall of the elevator shaft. Since the lower deflecting sheaves are disposed below the base frame, a long part of the hoisting element can be extended upward from the lower deflecting sheave. Consequently, the hoisting element can be smoothly wound round the lower deflecting sheaves and thereby the useful life of the hoisting element can be extended.

In the machine room-less elevator system according to the present invention, the support means may be provided with an opening, and a vertically extending part of the hoisting element may be passed through the opening.

In the machine room-less elevator system according to the present invention, the hoisting element and the support means do not interfere with each other. Therefore, the hoisting element can be most properly extended and the support means can be disposed at optimum positions.

The machine room-less elevator system according to the present invention may further include a control panel for controlling the operation of the driving device, disposed in a region near either the right or the left side wall of the elevator shaft of a space extending between the rear wall of the elevator shaft and a vertical plane including the rear surface of the car, and connected to the adjacent counterweight guide rail by a connecting member.

In the machine room-less elevator system according to the present invention, the control panel for controlling the operation of the driving device is disposed in the space between the vertical plane including the rear surface of the car and the rear wall of the elevator shaft and near either the right or the left side wall of the elevator shaft.

Since the control panel is not disposed in neither of a space between the right side wall of the car and the right side wall of the elevator shaft and a space between the left side wall of the car and the left side wall of the elevator shaft, the car can be formed in a width nearly equal to the distance between the right and the left side wall of the elevator shaft. In other words, the width of the elevator shaft may be nearly equal to that of the car and hence the width of the elevator shaft is narrower than that of the elevator shaft of the conventional elevator system including a car of the same width. Thus, the machine room-less elevator system of the present invention has improved space efficiency. Since the vibration-isolating means are held between the base frame and the counterweight guide rails to prevent the transmission of the vibrations generated by the driving device and the deflecting sheaves to the counterweight guide rails, the vibrations do not affect the function of the control panel, namely, precision equipment.

A machine room-less elevator system in a second aspect of the present invention having an elevator shaft and not having any machine room in an upper part of the elevator shaft includes: a car guided by right and left car guide rails for vertical movement in the elevator shaft; a counterweight guided by right and left counterweight guide rails for vertical movement in a space extending along the rear wall of the elevator shaft behind the car; a traction sheave disposed in a space at the top of the elevator shaft near either the right or the left side wall of the elevator shaft, and capable of being rotated about an axis of rotation diagonal to the side and the rear wall on a horizontal plane; a driving device for driving the traction sheave for rotation; a base frame fixedly supporting the driving device; base frame support means fixed to upper parts of the car guide rails and the counterweight guide rails; and vibration-isolating means interposed between the base frame and the base frame support means.

In the machine room-less elevator system according to the present invention, the driving device generates vibrations when the same operates to move the car and the counterweight vertically. Since the vibration-isolating means are interposed between the base frame fixedly supporting the driving device, and the base frame support means, the vibrations generated by the driving device are not transmitted through the car guide rails and the counterweight guide rails to the side walls and the rear wall of the elevator shaft. Since the vibration-isolating means are not subject to space restrictions imposed on the conventional vibration-isolating means including rubber vibration isolators held between the driving device and the base frame, the capacity of the vibration-isolating means can be sufficiently large.

When the driving device and the traction pulley are coaxial, the axis of the driving device extends diagonally to the side wall and the rear wall of the elevator shaft, and most part of the driving device is supported by, for example, the right car guide rail and the left counterweight guide rail. Consequently, the vibration-isolating means on the side of the right car guide rail and the vibration-isolating means on the side of the left counterweight guide rail can be spaced sufficiently apart from each other, the spring constant with respect to vertical directions of the vibration-isolating means may be small.

Since the base frame can be supported on the three vibration-isolating means including the vibration-isolating means on the side of the right counterweight guide rail, load on each of the vibration-isolating means is small. Thus, each of the vibration-isolating means can be designed in optimum dimensions and the propagation of vibrations generated by the driving device to the walls of the elevator shaft can be surely intercepted.

The degree of freedom of determining the positions of right and left car sheaves can be increased by properly determining the angle between the axis of rotation of the traction sheave and the side wall of the elevator shaft.

The hoisting element can be wound round the right and the left car sheave such that the hoisting element passes the center of gravity of the car on a horizontal plane by properly adjusting the angle between the axis of rotation of the traction pulley and the side wall of the elevator shaft on a horizontal plane.

The machine room-less elevator system according to the present invention may further include an upper deflecting sheave disposed near the rear wall of the elevator shaft, having an axis of rotation perpendicular to the rear wall of the elevator shaft and supported for rotation on the base frame to guide a part, extending toward the counterweight, of the hoisting element suspending the car and the counterweight.

In the machine room-less elevator system according to the present invention, the upper deflecting sheave generates vibrations as the car and the counterweight move vertically. Since the vibration-isolating means, such as rubber vibration isolators, are held between the base frame supporting the upper deflecting sheave and the support means, the vibrations generated by the upper deflecting sheave are not transmitted through the car guide rails and the counterweight guide rails to the side walls and the rear wall of the elevator shaft.

Since the upper deflecting sheave is disposed above the base frame, a long part of the hoisting element can be extended downward from the upper deflecting sheave. Thus, the hoisting element is wound smoothly round the upper deflecting sheave to extend the useful life of the hoisting element.

The machine room-less elevator system according to the present invention may further include: lower deflecting sheaves disposed below the traction sheave and near the side wall of the elevator shaft, and respectively having transverse axes of rotation perpendicular to the side wall of the elevator shaft to guide a part, extending downward from the traction sheave, of the hoisting element suspending the car and the counterweight, and a support frame supporting the lower deflecting sheave below the base frame; wherein the support frame includes a pair of vertical members having upper ends joined to support means fixed to the car guide rail and the counterweight guide rail, and extending vertically downward from the support means, a horizontal member extended horizontally between the lower ends of the vertical members, and vibration-isolating means held between the horizontal member and the lower ends of the vertical members.

In the machine room-less elevator system, the lower deflecting sheaves generate vibrations as the car and the counterweight move vertically. Since the vibration isolating means, such as rubber vibration isolators, are held between the vertical members and the horizontal member of the support frame supporting the lower deflecting sheaves, the vibrations generated by the lower deflecting sheaves are not transmitted through the car guide rails and the counterweight guide rails to the side walls and the rear wall of the elevator shaft. Since there are not any restrictions on space necessary for installing the vibration-isolating means, the capacity of the vibration-isolating means can be sufficiently large. Since the vibration-isolating means can be spaced sufficiently apart from each other, the spring constant with respect to vertical directions of the vibration-isolating means may be small. Thus, each of the vibration-isolating means can be designed in optimum dimensions and the propagation of vibrations generated by the lower deflecting sheaves to the side walls and the rear wall of the elevator shaft can be surely intercepted.

A long part of the hoisting element can be extended upward from the lower deflecting sheave by increasing the length of the longitudinal members. Consequently, the hoisting element can be smoothly wound round the lower deflecting sheaves and thereby the useful life of the hoisting element can be extended.

The machine room-less elevator system according to the present invention may further include a control panel for controlling the operation of the driving device, disposed in a region near either of the right or the left side wall of the elevator shaft of a space extending between the rear wall of the elevator shaft and a vertical plane including the rear surface of the car, and connected to the adjacent counterweight guide rail by a connecting member.

In the machine room-less elevator system according to the present invention, the control panel for controlling the operation of the driving device is disposed in a space between the rear wall of the car and the rear wall of the elevator shaft and near either the right or the left side wall of the elevator shaft.

Since the control panel is not disposed in neither of a space between the right side wall of the car and the right side wall of the elevator shaft and a space between the left side wall of the car and the left side wall of the elevator shaft, the car can be formed in a width nearly equal to the distance between the right and the left side wall of the elevator shaft; that is the width of the elevator shaft may be nearly equal to that of the car and hence the width of the elevator shaft is narrower than that of the elevator shaft of the conventional elevator system including a car of the same width. Thus, the machine room-less elevator system of the present invention has improved space efficiency. Since the vibration-isolating means are held between the base frame and the counterweight guide rails to prevent the transmission of the vibrations generated by the driving device and the deflecting sheaves to the counterweight guide rails, the vibrations do not affect the function of the control panel, namely, precision equipment.

In the machine room-less elevator system according to the present invention, the base frame may include a side support beam perpendicular to the rear wall of the elevator shaft and extending along the side wall of the elevator shaft, a rear support beam laterally extending along the rear wall of the elevator shaft, a diagonal support beam parallel to the axis of rotation of the traction sheave and fixedly supporting the driving device thereon, and connecting members connecting the side, the rear and the diagonal support beam.

The support beams and the connecting members can be individually carried to the top of the elevator shaft, and the base frame can be built by fastening together the support beams and the connecting members with bolts and nuts. Thus, the support beams, the connecting members and such can be easily carried up to and assembled at the top of the elevator shaft in installing the machine room-less elevator system.

In the machine room-less elevator system according to the present invention, the side support beam, the rear support beam and the diagonal support beam may be formed by processing shape steels having an open side.

The open sides of the support beams facilitate inserting a tool in the support beams in assembling the base frame by fastening together the support beams with the bolts and the nuts, so that the base frame can be easily assembled. The base frame built by assembling the shape steels has high rigidity and can be built at a low cost.

In the machine room-less elevator system according to the present invention, the opposite ends of the diagonal support beam are placed on and fastened to the side support beam and the rear support beam.

The diagonal support beam supporting the driving device thereon can be firmly held by the highly rigid side support beam and the rear support beam.

In the machine room-less elevator system according to the present invention, the rear support beam may be provided with an opening, and a part, extending downward from the upper deflecting sheave, of the hoisting element is passed through the opening of the rear support beam.

In the machine room-less elevator system according to the present invention, the side support beam may be provided with an opening, and a part, extending downward from the traction sheave, of the hoisting element is passed through the opening of the side support beam.

In the machine room-less elevator system according to the present invention, the support means may be provided with an opening, and a vertically extending part of the hoisting element is passed through the opening of the support means.

Thus, the support beams of the base frame, and the support means can be positioned at predetermined positions between the guide rails, and the hoisting element can be efficiently extended.

BEST MODE FOR CARRYING OUT THE INVENTION

Figure 1:
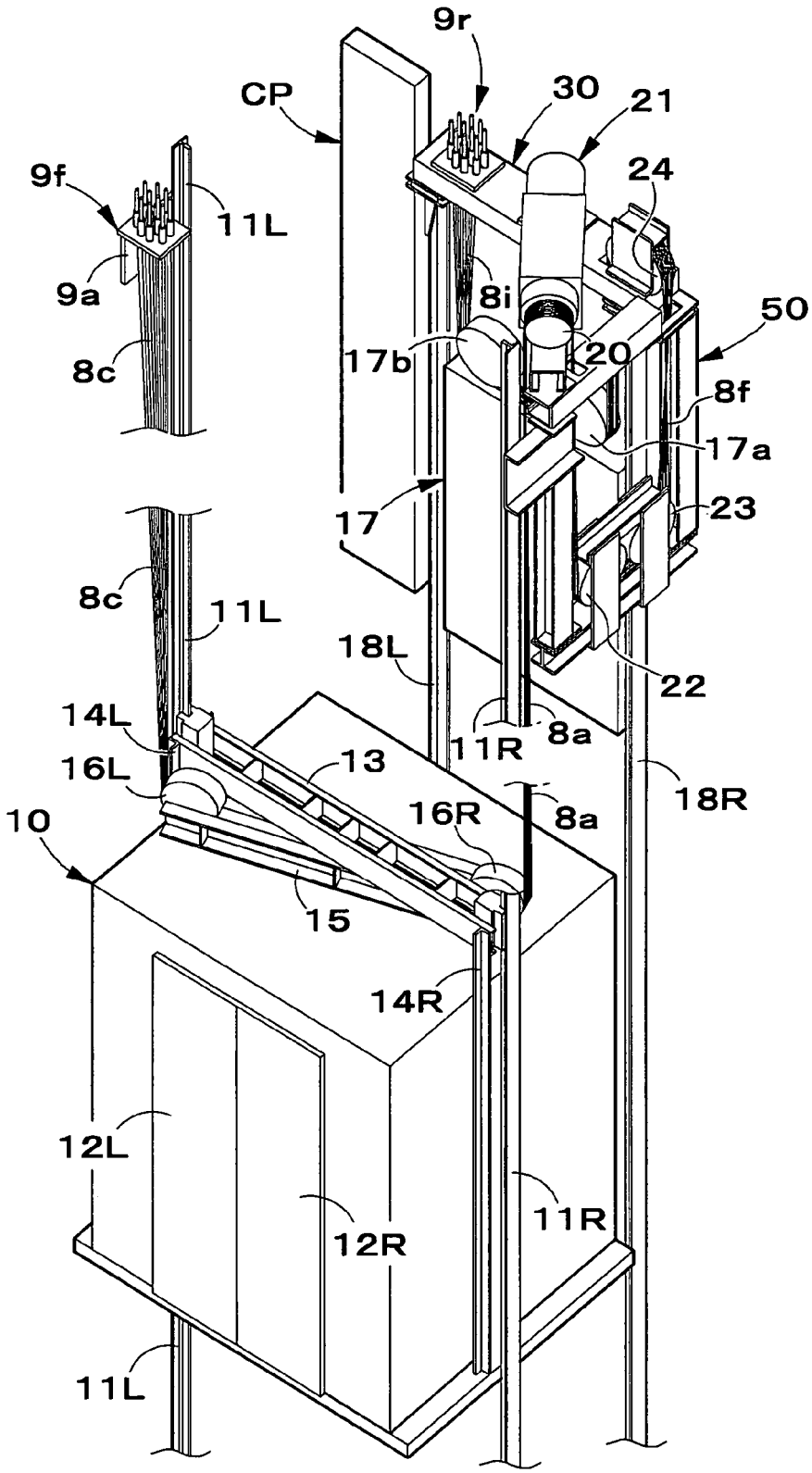
FIG. 1 is a perspective view of a machine room-less elevator system in a preferred embodiment according to the present invention taken from the front right-hand side of the machine room-less elevator system.

A machine room-less elevator system in a preferred embodiment according to the present invention will be described with reference to FIGS. 1 to 5. In the following description, directions in which the doors of a car moves are called lateral directions, a direction in which persons walk out of the car is a forward direction, a direction in which persons walk into the car is a rearward direction, and directions in which the car moves are vertical directions. Parts of a hoisting element corresponding to the parts of the hoisting element of the machine room-less elevator system shown in FIG. 6 are designated by the same reference characters.

A machine room-less elevator system in a preferred embodiment according to the present invention shown in FIGS. 1 to 5 has a car 10 guided by a right car guide rail 11R and a left car guide rail 11L for vertical movement in an elevator shaft S formed in a building. A right door 12R and a left door 12L placed in the open front side of the car 10 move in lateral directions for opening and closing. A car frame supporting the car 10 has an upper beam 13 extending horizontally laterally above the car 10, and a right vertical beam 14R vertically extended between a right end part of the upper beam 13 and the bottom of the car 10, and a left vertical beam 14L vertically extending between a left end part of the upper beam 13 and the bottom of the car 10.

Figure 5:
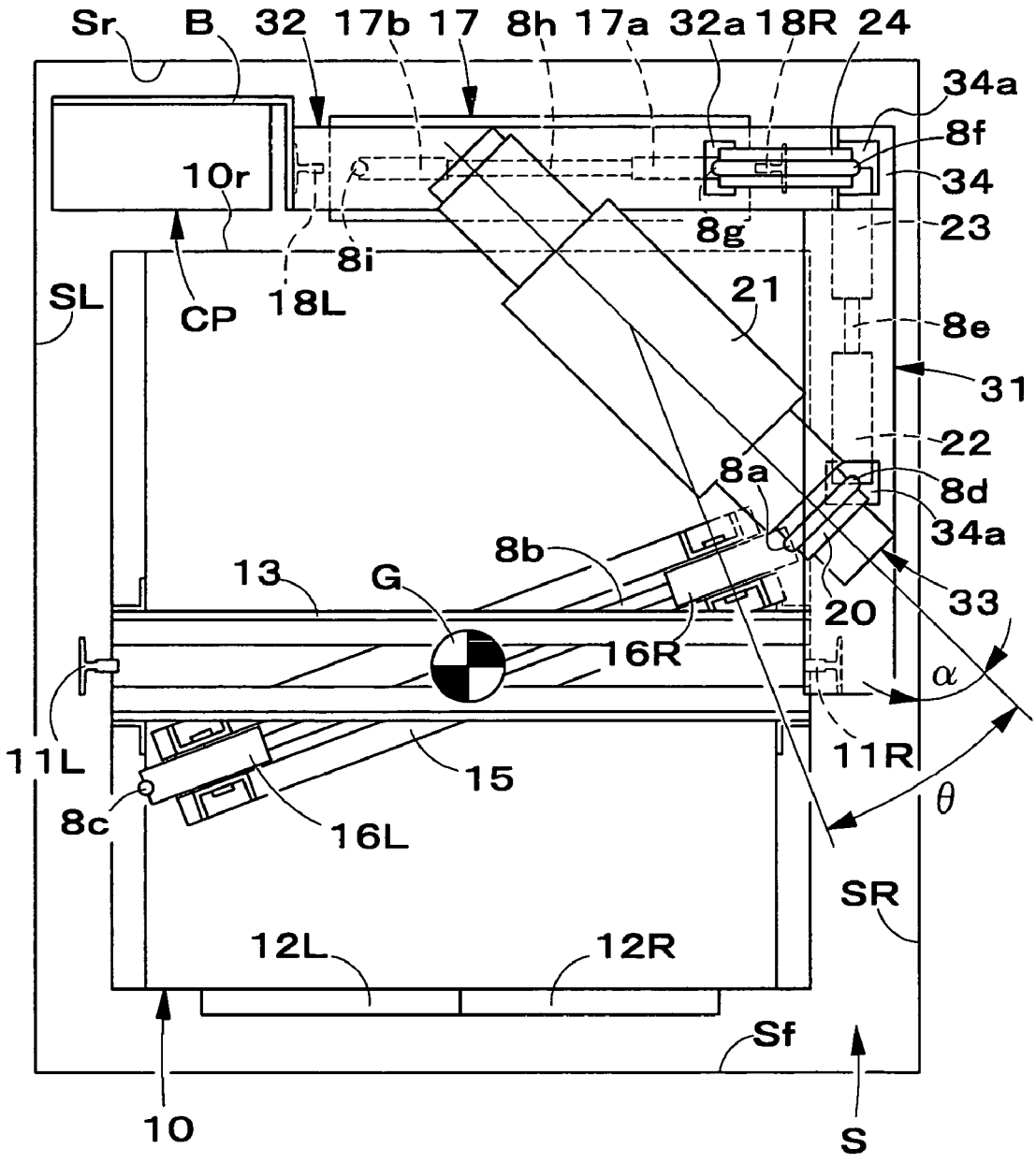
FIG. 5 is a top plan view of the machine room-less elevator system shown in FIG. 1.
Figure 6:
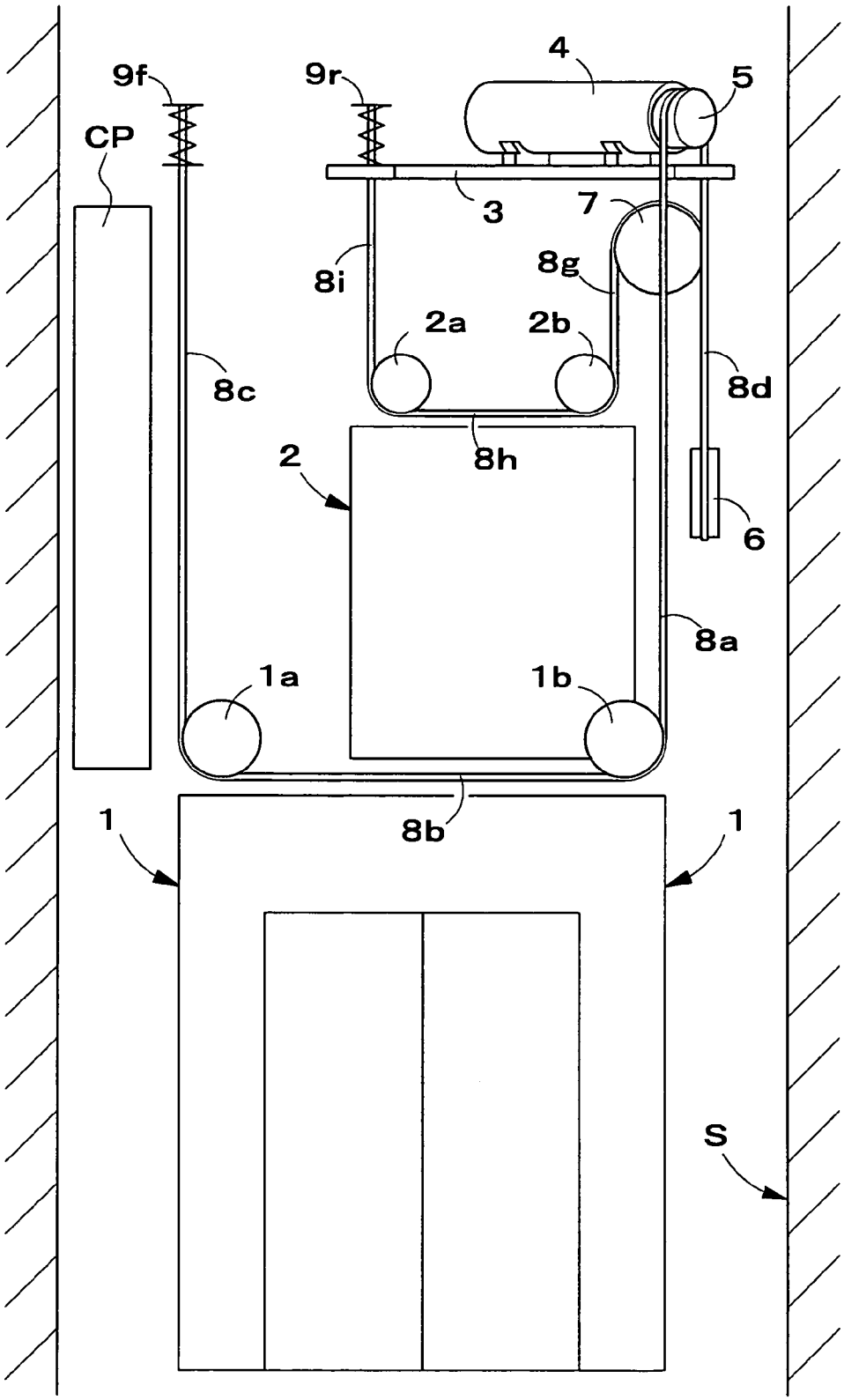
FIG. 6 is a typical perspective view of a conventional machine room-less elevator system.

A sheave support beam 15 is disposed in a space between the car 10 and the upper beam 13 so as to extend at an angle to the upper beam 13 in a horizontal plane as shown in FIG. 5. The sheave support beam 13 is space apart from the top wall of the car 10. The upper surface of a middle part of the sheave support beam 15 is joined to the lower surface of a middle part of the upper beam 13. The sheave support beam 15 is extended such that the respective axes of rotation of upper car sheaves 16R and 16L are inclined at an angle θ to the axis of rotation of a traction sheave 20.

The right upper car sheave 16R and the left upper car sheave 16L are supported rotatably on right and left end parts, respectively, of the sheave support beam 15. Upward forces exerted on the right upper car sheave 16R and the left upper car sheave 16L to suspend the car 10 are transmitted respectively through the sheave support beam 15, the upper beam 13 and the right vertical beam 14R and the left vertical beam 14L to the bottom of the car 10.

The right upper car sheave 16R and the left upper car sheave 16L are symmetrical with respect to the center G of gravity of the car 10. In other words, the upper car sheaves 16R and 16L are disposed such that a part 8*b*, horizontally extending between the upper car sheaves 16R and 16L, of a hoisting element 8 crosses a vertical line passing the center G of gravity of the car 10. A right car guide rail 11R and a left car guide rail 11L are symmetrical with respect to the center G of gravity of the car 10. Consequently, the car 10 can be stably suspended without being tilted.

As shown in FIG. 5, a counterweight 17 included in the machine room-less elevator system of the present invention is guided by a right counterweight guide rail 18R and a left counterweight guide rail 18L for vertical movement in a right-hand region near the right side wall SR of an elevator shaft S of a space extending between the rear wall Sr of the elevator shaft S and the rear surface 10*r* of the car 10. A right counterweight sheave 17*a* and a left counterweight sheave 17*b* are supported on upper parts of the counterweight 17 for rotation about axes of ration perpendicular to the rear wall Sr of the elevator shaft S.

A control panel CP for controlling the operation of a driving device 21 is disposed in a left-hand region near the left side wall SL of the elevator shaft S of the space extending between the rear wall Sr of the elevator shaft S and the rear surface 10*r* of the car 10. The control panel CP is held by a plurality of brackets B attached to the left counterweight guide rail 18L.

As shown in FIGS. 1 to 5, the traction sheave 20 is disposed near a substantially middle part, with respect to a longitudinal direction, of a top part of the right side wall SR of the elevator shaft S. The axis of rotation of the traction sheave 20 is inclined at an angle α to the right side wall SR on a horizontal plane, so that the axis of rotation of the traction sheave 20 extends obliquely to the right side wall S$ and the rear wall Sr on a horizontal plane.

The driving device 21 is disposed behind the traction sheave 20 coaxially with the latter to drive the traction sheave 20 for rotation. The driving device 21 is mounted on and held firmly on a horizontal base frame 30 held on the respective upper ends of the counterweight guide rails 18R and 18L and the upper end of the right car guide rail 11R.

Figure 4:
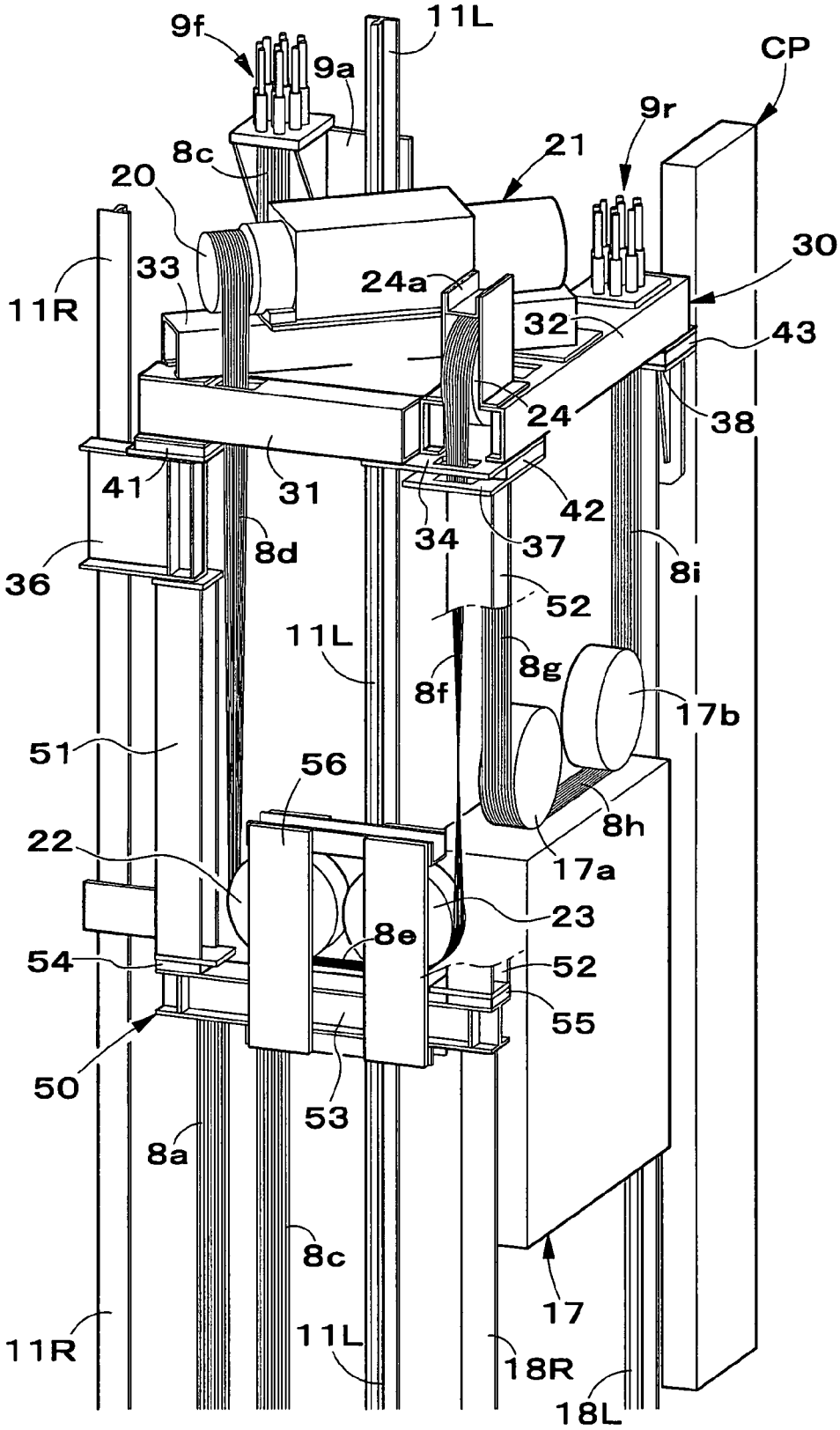
FIG. 4 is a perspective view of an essential part of the machine room-less elevator system shown in FIG. 3.

Referring to FIGS. 4 and 5, the base frame 30 is formed by assembling three support beams 31, 32 and 33 and a connecting plate 34. The right side beam 31 is horizontally extended near the right side wall SR of the elevator shaft S between the upper ends of the right car guide rail 11R and the right counterweight guide rail 18R. The right support beam 31 is a steel channel having a U-shaped cross section. The rear support beam 32 is horizontally extended near the rear wall Sr of the elevator shaft S between the upper ends of the counterweight guide rails 18R and 18L. The rear support beam 32 is a steel channel having a U-shaped cross section. The diagonal support beam 33 is extended parallel to the axis of rotation of the traction sheave 20 and has opposite end parts fixedly mounted on the support beams 31 and 32. The diagonal support beam 33 is a steel channel having a U-shaped cross section. The horizontal connecting plate 34 is attached to the respective lower surfaces of the rear end of the right support beam 31 and the right end of the rear support beam 32 to connect the right support beam 31 and the rear support beam 32 firmly together.

The base frame 30 is built by fastening together the support beams 31, 32 and 33 and the connecting plate 34 with bolts and nuts. Thus, the support beams 31, 32 and 33 and the connecting plate 34 can be easily carried to and assembled at the top of the elevator shaft S in installing the machine room-less elevator system. The steel channels each having one open side and serving as the support beams 31, 32 and 33 facilitate assembling work using the bolts and the nuts for assembling the base frame 30.

As shown in FIG. 4, the base frame 30 is supported horizontally on a first support means 36 fixed to an upper part of the right car guide rail 11R, a second support means 37 fixed to an upper part of the right counterweight guide rail 18R, and a third support means 38 fixed to an upper part of the left counterweight guide rail 18L. The support means 36, 37 and 38 may be formed, for example, by assembling thick steel plates and steel shapes.

A first rubber vibration isolator 41, a second rubber vibration isolator 42 and a third rubber vibration isolator 43 as vibration-isolating means, are held between the front end of the right support beam 31 and the first support means 36, between the connecting plate 34 attached to the right end of the rear support beam 32 and the second support means 37, and between the left end of the rear support beam 32 and the third support means 38, respectively, to intercept the transmission of vibrations from the base frame 30 to the guide rails.

Figure 2:
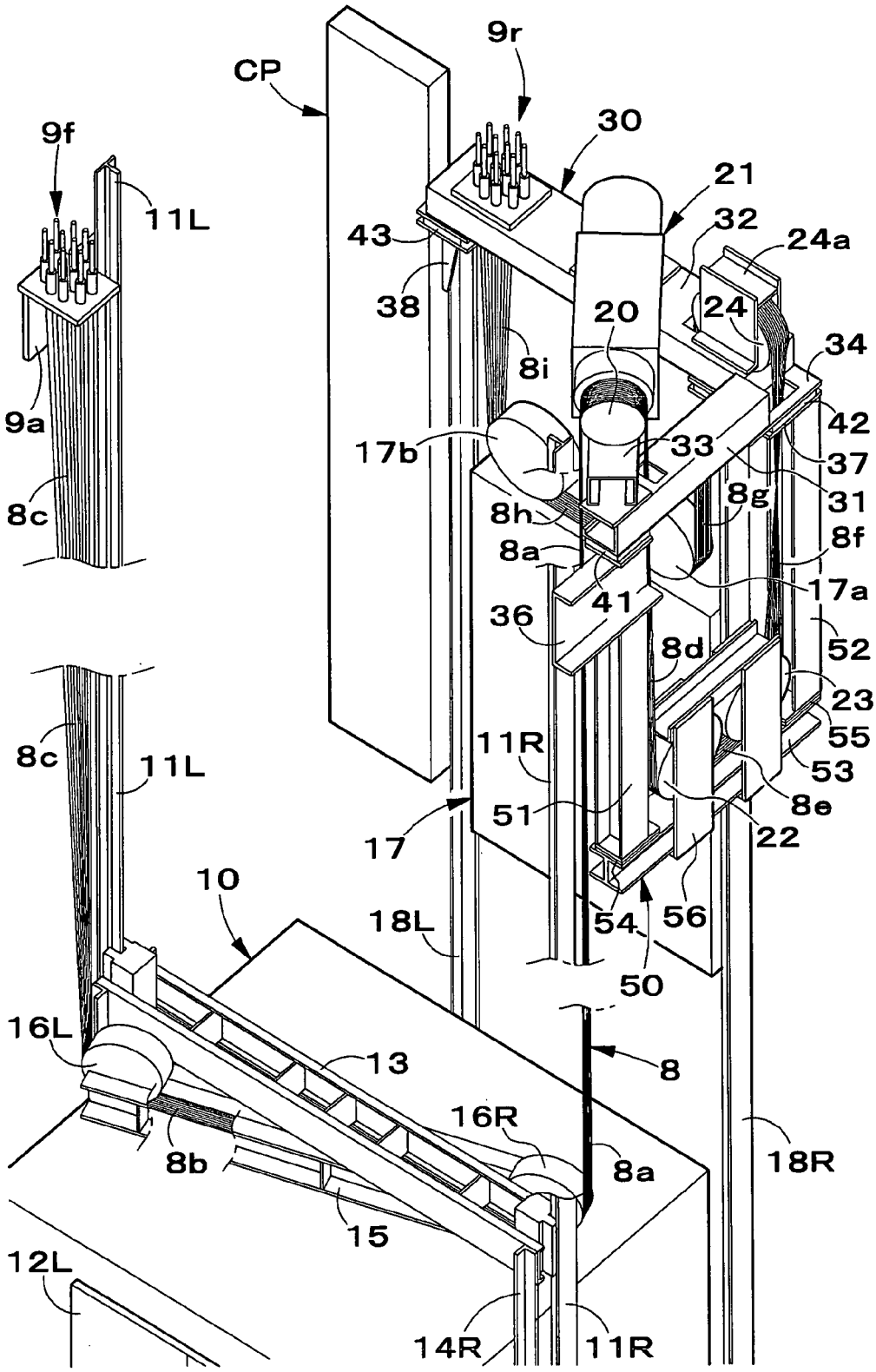
FIG. 2 is an enlarge perspective view of an essential part of the machine room-less elevator system shown in FIG. 1.
Figure 3:
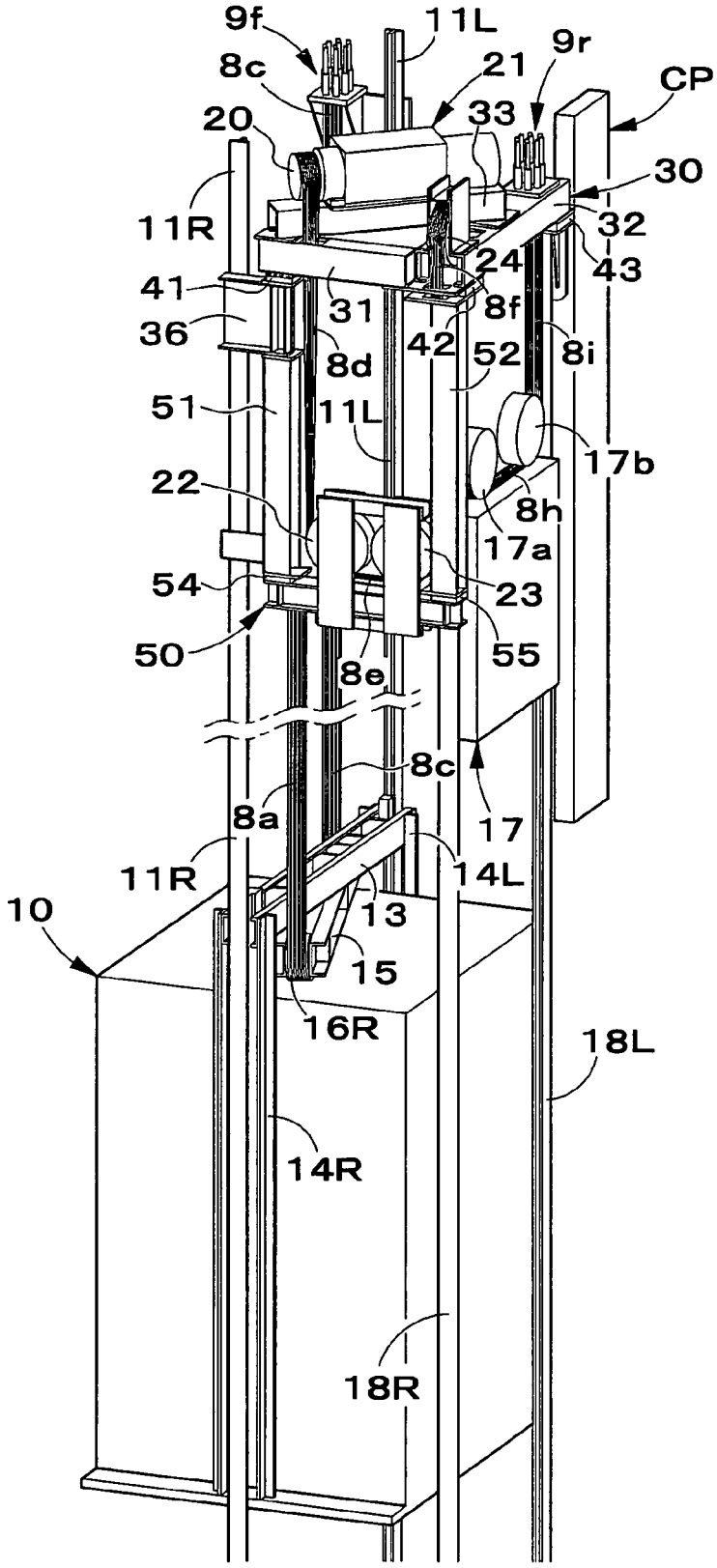
FIG. 3 is a perspective view of the machine room-less elevator system shown in FIG. 1 taken from the back right-hand side of the machine room-less elevator system.

Referring to FIGS. 2 and 4, two lower deflecting sheaves 22 and 23 are disposed directly below the right support beam 31 and are supported for rotation on a support frame 50 with their axes of rotation extended laterally on a horizontal plane. The lower deflecting sheaves 22 and 23 are able to rotate about their axes of rotation. The support frame 50 has opposite ends fixedly connected to the first support means 36 and the second support means 37.

As shown in FIGS. 2 and 4, the support frame 50 has a first vertical member 51 extending vertically downward from the lower surface of the first support means 36, a second vertical member 52 extending vertically downward from the lower surface of the second support means 37, and a horizontal member 53 extending longitudinally on a horizontal plane between the lower ends of the vertical members 51 and 52. The members 51, 52 and 53 are formed by processing highly rigid steel shapes. A fourth rubber vibration isolator 54 and a fifth rubber vibration isolator 55 are held between the upper surface of the front end of the horizontal member 53 and the lower surface of the first vertical member 51 and between the upper surface of the rear end of the horizontal member 53 and the lower surface of the second vertical member 52, respectively, to intercept the transmission of vibrations from the horizontal member 53 to the vertical members 51 and 52. The lower deflecting sheaves 22 and 23 are supported for rotation on the horizontal member 53 by a bracket 56 fixed to the horizontal member 53.

As shown in FIG. 4, an upper deflecting sheave 24 is supported for rotation about a horizontal, longitudinal axis of rotation by a bracket 24*a* firmly attached to the upper surface of the right end of the rear support beam 32 of the base frame 30. A vertical opening 32*a* is formed in a right end part of the rear support beam 32. Parts 8*f* and 8*g* of the hoisting element 8 extending vertically downward from the upper deflecting sheave 24 pass the vertical opening 32*a* of the rear support beam 32. Vertical openings 34*a* and 37*a* are formed in the connecting plate 34 and the second support means 37, respectively.

As shown in FIG. 2, a rear hitch 9*r* is attached to the upper surface of the left end of the rear support beam 32 of the base frame 30. One end of the hoisting element 8 is hitched to the rear hitch 9*r*. A front hitch 9*f* is held by a bracket 9*a* attached to an upper part of the left car guide rail 11L. The other end of the hoisting element 8 is hitched to the front hitch 9*f*.

The hoisting element 8 consists of, for example, ten parallel 5 mm diameter ropes and is wound round the traction sheave 20. The hoisting element 8 has car-hoisting section including a part 8*a* extending vertically downward from the traction sheave 20 toward the right upper car sheave 16R passing near the front end of the right support beam 31, a horizontal part 8*b* extending between the upper car sheaves 16R and 16L, and a part 8*c* extending upward from the left upper car sheave 16L and hitched to the front hitch 9*f*. The car-suspending section of the hoisting element 8 suspends the car 10 in 2-to-1 roping.

As shown in FIG. 5, the upper car sheave 16R and 16L are symmetrical with respect to the center G of gravity of the car 10, and the car guide rails 11R and 11L are symmetrical with respect to the Center G of gravity of the car 10. Thus, the weight of the car 10 is not horizontally greatly offset with respect to a lifting force that acts on the car 10. Consequently, the car 10 can be stably suspended without being tilted and is able to move smoothly vertically without shaking.

As shown in FIG. 4, the hoisting element 8 has a counterweight-hoisting section including a part 8*d* extending vertically downward from the traction sheave 20 toward the front lower deflecting sheave 22, a horizontal part 8*e* extending between the lower deflecting sheaves 22 and 23, a part 8*f* extending vertically upward from the rear lower deflecting sheave 23 toward the upper deflecting sheave 24, a part 8*g* wound round the upper deflecting sheave 24 and extending vertically downward to the right counterweight sheave 17*a*, a horizontal part 8*h* extending between the counterweight sheaves 17*a* and 17*b*, and a part 8*i* extending upward from the left counterweight sheave 17*b* and hitched to the rear hitch 9*r*. The counterweight-hoisting section suspends the counterweight 17 in 2-to-1 roping.

The driving device 21 generates vibrations when the driving device 21 operates to move the car 10 and the counterweight 17 vertically. Since the base frame 30 firmly holding the driving device 21 is mounted on the rubber vibration isolators 41, 42 and 43 supported on the support means 36, 37 and 38, the support means 36, 37 and 38 are isolated from vibrations. Thus the vibrations generated by the driving device 21 are not transmitted through the right car guide rail 11R and the counterweight guide rails 18R and 18L to the right side wall SR and the rear wall S4 of the elevator shaft S.

Since the rubber vibration isolators are not subject to space restrictions imposed on the conventional technique that places rubber vibration isolators between the driving device and the base frame, the rubber vibration isolators 41, 42 and 43 may be those having a large capacity. Since the rubber vibration isolators 41, 42 and 43 can be spaced sufficiently apart from each other, the spring constant with respect to vertical directions of the rubber vibration isolators 41, 42 and 43 may be small. Thus the rubber vibration isolators 41, 42 and 43 can be formed in optimum dimensions to prevent the propagation of vibrations generated by the driving device 21 with reliability.

The driving device 21 coaxial with the traction sheave 20 extends diagonally between the right side wall SR and the rear wall Sr of the elevator shaft S. Therefore, most of the weight of the driving device 21 can be supported by the right car guide rail 11R and the left counterweight guide rail 18L. Since the first rubber vibration isolator 41 and the third rubber vibration isolator 43 are spaced sufficiently apart from each other, the spring constants of the rubber vibration isolators 41 and 43 with respect to vertical directions may be small. Since the base frame 30 is supported on the three rubber vibration isolators 41, 42 and 43, load on each of the rubber vibration isolators 41, 42 and 43 is small. Consequently, the transmission of the vibrations generated by the driving device 21 to the right side wall SR and the rear wall Sr of the elevator shaft S can be surely prevented.

The two lower deflecting sheaves 22 and 23 rotate and generate vibrations as the car 10 and the counterweight 17 move vertically. Upward external force exerted by the hoisting element 8 on the pair of lower deflecting sheaves 22 and 23 varies according to the vertical movement and stopping of the car 10 and the counterweight 17. Since the rubber vibration isolators 54 and 55 are held between the upper surface of the front end of the horizontal member 53 and the lower surface of the first vertical member 51 and between the upper surface of the rear end of the horizontal member 53 and the lower surface of the second vertical member 52, respectively, vibrations generated by the pair of lower deflecting sheaves 22 and 23, and variation of the external force are not transmitted through the right car guide rail 11R and the right counterweight guide rail 18R to the right side wall SR and the rear wall Sr of the elevator shaft S.

The upper deflecting sheave 24 rotates and generates vibrations as the car 10 and the counterweight 17 move vertically. Downward external force exerted by the hoisting element 8 on the upper deflecting sheave 24 varies according to the vertical movement and stopping of the car 10 and the counterweight 17. Since the base frame 30 firmly supporting the upper deflecting sheave 24 is supported on the rubber vibration isolators 41, 42 and 43 mounted on the support means 36, 37 and 38, vibrations generated by the upper deflecting sheave 24 are not transmitted through the right counterweight guide rail 18R and the left counterweight guide rail 18L to the right side wall SR and the rear wall Sr of the elevator shaft S.

Since the upper deflecting sheave 24 is supported on the base frame 30, the vertical interval between the upper deflecting sheave 24, and the lower deflecting sheaves 22 and 23 can be increased. The vertical position of the pair of lower deflecting sheaves 22 and 23 can be optionally determined by adjusting the length of the vertical members 51 and 52 of the support frame 50. Thus the lower deflecting sheaves 22 and 23 can be spaced a long distance apart from the upper deflecting sheave 24. Consequently, the parts 8*d*, 8*e*, 8*f* and 8*g*, extending from the traction sheave 20 via the lower deflecting sheaves 22 and 23 and the upper deflecting sheaves 24 to the counterweight sheaves 17*a* and 17*b*, of the hoisting element 8 can be further smoothly extended and thereby the useful life of the hoisting element 8 can be further extended. Since all the parts of the hoisting element 8 are evenly tensioned, the car 10 will not shake vertically at starting, and noise generation due to the engagement of the hoisting element 8 with the side walls of the grooves of the sheaves can be prevented.

Since the upper deflecting sheave 24 is supported on the base frame 30, the upper deflecting sheave 24 and the counterweight 17 never interfere with each other. Consequently, the vertical stroke of the counterweight 17 can be sufficiently long.

In the machine room-less elevator system embodying the present invention, the control panel CP for controlling the operation of the driving device 21 is disposed in the left-hand region near the left side wall SL of the elevator shaft S of the space extending between the rear wall Sr of the elevator shaft S and the rear surface 10*r* of the car 10. Therefore, the car 10 can be formed in a width nearly equal to the distance between the right side wall SR and the left side wall SL of the elevator shaft S. In other words, the width of the elevator shaft S may be nearly equal to that of the car 10 and hence the width of the elevator shaft S is narrower than that of the elevator shaft of the conventional elevator system including a car of the same width. Since the vibrations generated by the deflecting sheaves 22, 23 and 24 are not transmitted to the left car guide rail 18L holding the control panel CP, the vibrations do not affect adversely the function of the control panel CP, namely, precision equipment.

On a horizontal plane, the control panel CP is disposed on the left-hand side of the left counterweight guide rail 18L, and the driving device 21 and the base frame 30 are disposed on the right-hand side of the left counterweight guide rail 18L. Therefore, the direction in which the bending moment resulting from the weight of the control panel CP tends to bend the left counterweight guide rail 18L, and that in which the bending moment resulting from the weight of the driving device 21 and the base frame 30 and tending to bend the left counterweight guide rail 18L through the third support means 38 are opposite to each other, and hence those bending moments cancel each other. Consequently, the degree of bending of the left counterweight guide rail 18L caused by the weight of the driving device 21 and the base frame 30 can be remarkably reduced.

Although the machine room-less elevator system embodying the present invention has been described, the present invention is not limited there to in its practical application and various change and variations are possible therein. For example, the rubber vibration isolators may be replaced with damping devices each formed by combining an elastic element, such as a coil spring, and a damping means, such as an oil damper.

In the foregoing embodiment, the support frame 50 supporting the lower deflecting sheaves 22 and 23 is fixed to the first support means 36 and the second support means 37, and the fourth rubber vibration isolator 54 and the fifth rubber vibration isolator 55 are held between the horizontal member 53 and the first vertical member 51 and between the horizontal member 53 and the second vertical member 52, respectively. The upper ends of the first vertical member 51 and the second vertical member 52 of the support frame 50 may be directly joined to the lower surface of the base frame 30, and the fourth rubber vibration isolator 54 and the fifth rubber vibration isolator 55 may be omitted.

INDUSTRIAL APPLICABILITY

As apparent from the foregoing description, according to the present invention, the vibrations generated by the driving device, the lower deflecting sheaves and the upper deflecting sheaves as the car and the counterweight move vertically are not transmitted through the guide rails to the side walls of the elevator shaft. The hoisting element can be smoothly extended between the upper deflecting sheave and the lower deflecting sheaves and thereby the useful life of the hoisting element can be extended. The car of the machine room-less elevator system has high space efficiency.

The invention claimed is:

1. A machine room-less elevator system having an elevator shaft and not having any machine room in an upper part of the elevator shaft, said machine room-less elevator system comprising:

a car guided by car guide rails for vertical movement in the elevator shaft;

a counterweight guided by counterweight guide rails for vertical movement in a space extending along the rear wall of the elevator shaft behind the car;

a traction sheave disposed in a space above the car at the top of the elevator shaft on either the right-hand or the left-hand side of the car;

a driving device for driving the traction sheave for rotation;

a base frame fixedly supporting the driving device;

base frame support means fixed to one of the car guide rails and the counterweight guide rails; and vibration-isolating means interposed between the base frame and the base frame support means, wherein the base frame includes:

a side support beam perpendicular to the rear wall of the elevator shaft and extending along the side wall of the elevator shaft, a rear support beam laterally extending along the rear wall of the elevator shaft, a diagonal support beam parallel to the axis of rotation of the traction sheave and fixedly supporting the driving device thereon, and connecting members connecting the side, the rear and the diagonal support beam.

2. The machine room-less elevator according to claim 1 further comprising an upper deflecting sheave for guiding a part, extending toward the counterweight, of the hoisting element suspending the car and the counterweight, and the upper deflecting sheave is supported on the base frame.

3. The machine room-less elevator system according to claim 1 further comprising lower deflecting sheaves supported on a support frame connected to and extending down from the base frame to guide a part, extending downward from the traction sheave, of a hoisting element suspending the car and the counterweight.

4. The machine room-less elevator system according to claim 1, wherein the base frame support means is provided with an opening, and a vertically extending part of the hoisting element is passed through the opening.

5. The machine room-less elevator system according to claim 1 further comprising a control panel for controlling the operation of the driving device, disposed in a region near either of the right or the left side wall of the elevator shaft of a space extending between the rear wall of the elevator shaft and a vertical plane including the rear surface of the car, and connected to the adjacent counterweight guide rail by a connecting member.

6. A machine room-less elevator system having an elevator shaft and not having any machine room in an upper part of the elevator shaft, said machine room-less elevator system comprising:

a car guided by right and left car guide rails for vertical movement in the elevator shaft;

a counterweight guided by right and left counterweight guide rails for vertical movement in a space extending along the rear wall of the elevator shaft behind the car;

a traction sheave disposed in a space at the top of the elevator shaft near either the right or the left side wall of the elevator shaft, and capable of being rotated about an axis of rotation diagonal to the side and the rear wall on a horizontal plane;

a driving device for driving the traction sheave for rotation;

a base frame fixedly supporting the driving device;

base frame support means fixed to an upper part of one of the car guide rails and to upper parts of the counterweight guide rails; and vibration-isolating means interposed between the base frame and the base frame support means, wherein the base frame includes:

a side support beam perpendicular to the rear wall of the elevator shaft and extending along the side wall of the elevator shaft, a rear support beam laterally extending along the rear wall of the elevator shaft, a diagonal support beam parallel to the axis of rotation of the traction sheave and fixedly supporting the driving device thereon, and connecting members connecting the side, the rear and the diagonal support beam.

7. The machine room-less elevator system according to claim 6 further comprising an upper deflecting sheave disposed near the rear wall of the elevator shaft, having an axis of rotation perpendicular to the rear wall of the elevator shaft and supported for rotation on the base frame to guide a part, extending toward the counterweight, of the hoisting element suspending the car and the counterweight.

8. The machine room-less elevator system according to claim 6 further comprising:

lower deflecting sheaves disposed below the traction sheave and near the side wall of the elevator shaft, and respectively having transverse axes of rotation perpendicular to the side wall of the elevator shaft to guide a part, extending downward from the traction sheave, of the hoisting element suspending the car and the counterweight, and a support frame supporting the lower deflecting sheaves below the base frame;

wherein the support frame includes a pair of vertical members having upper ends joined to the base frame support means fixed to one of the car guide rails and the counterweight guide rails, and extending vertically downward from the base frame support means, a horizontal member extended horizontally between the lower ends of the vertical members, and vibration-isolating means held between the horizontal member and the lower ends of the vertical members.

9. The machine room-less elevator system according to claim 6 further comprising a control panel for controlling the operation of the driving device, disposed in a region near either of the right or the left side wall of the elevator shaft of a space extending between the rear wall of the elevator shaft and a vertical plane including the rear surface of the car, and connected to the adjacent counterweight guide rail by a connecting member.

10. The machine room-less elevator system according to claim 6, wherein the opposite ends of the diagonal support beam are placed on and fastened to the side support beam and the rear support beam.

11. The machine room-less elevator system according to claim 6, wherein the rear support beam is provided with an opening, and a part, extending downward from the upper deflecting sheave, of the hoisting element is passed through the opening of the rear support beam.

12. The machine room-less elevator system according to claim 6, wherein the side support beam the rear support beam and the diagonal support beam is formed by processing shape steels having one open side.

13. The machine room-less elevator system according to claim 6, wherein the side support beam is provided with an opening, and a part, extending downward from the traction sheave, of the hoisting element is passed through the opening of the side support beam.

14. The machine room-less elevator system according to claim 6, wherein the support means is provided with an opening, and a vertically extending part of the hoisting element is passed through the opening of the support means.

* * * * *